United States Patent [19]

Hewitt et al.

[11] Patent Number: 4,579,057

[45] Date of Patent: Apr. 1, 1986

[54] STAMPER WITH ROTATABLE COVER

[76] Inventors: Stephen K. Hewitt, 493 Montana Cir., Ojai, Calif. 93023; Per-Arne Carlsson, Nordangsgstan 38, S-502 43 Boras; Bengt Darhult, Hostena Gard, S-310 58 Vessigebro, both of Sweden

[21] Appl. No.: 606,903

[22] Filed: May 4, 1984

[51] Int. Cl.[4] ..... B41C 47/02

[52] U.S. Cl. ..... 101/368; 101/379

[58] Field of Search ..... 101/326, 333, 334, 368, 101/379, 405

[56] References Cited

U.S. PATENT DOCUMENTS

| | | | |
|---|---|---|---|
| 1,177,740 | 4/1916 | Tully | 101/368 |
| 2,900,902 | 8/1959 | Becker | 101/368 |
| 2,919,645 | 1/1960 | Leeds | 101/405 |
| 3,216,352 | 11/1965 | Schnackel | 101/333 |
| 3,478,682 | 11/1969 | Funahashi | 101/368 |
| 3,855,925 | 12/1974 | Funahashi | 101/333 |
| 4,392,425 | 7/1983 | Capezzuto et al. | 101/379 X |
| 4,432,281 | 2/1984 | Wall et al. | 101/334 |

FOREIGN PATENT DOCUMENTS

| | | | |
|---|---|---|---|
| 671807 | 5/1952 | United Kingdom | 101/368 |
| 2050250 | 1/1981 | United Kingdom | 101/405 |

*Primary Examiner*—Clifford D. Crowder
*Assistant Examiner*—John A. Weresh
*Attorney, Agent, or Firm*—Marvin E. Jacobs

[57] ABSTRACT

An improved ink stamp (10) includes an upper housing (12) receiving a stationary stamper element holder (14) and a translatable shield (16) biased downwardly by means of a spring (104) such that the lip (80) extends past the printing surface of the stamp element (20). A cover (18) having side arms (32, 34) joined by a cover face (36) rotates from a first position over the stamp element (20) to a second position over the curved, top surface (24) of the housing (12). The cover may also include means for locking the cover in both positions such as a set of protuberances (62, 64) provided on the side walls (50, 52) of the housing which are received in corresponding detents (66, 68) provided on the inner surface of each side arm (32, 34).

11 Claims, 6 Drawing Figures

STAMPER WITH ROTATABLE COVER

TECHNICAL FIELD

This invention relates to imprinting stamp messages, and more particularly, to a pre-inked stamp with a cover.

BACKGROUND ART

The fixed message stamp with custom or standard imprints is a necessary device in modern businesses, especially in bookkeeping, accounting, billing and mail handling. The earliest stamps were hard rubber, and they were inked from a pad before the message was transferred and imprinted on the document or package. However, the stamp was usually over-inked and the excess ink would end up on the fingers, hands and clothing of the user, and unnecessary and unwanted imprints were made on every surface that came in contact with the face of the stamp.

Recently, a pre-inked stamp element became available in which the ink was contained in micropores within the elastomeric stamp material. This eliminated the messy stamp pad and ink bottle for re-inking the pad. The pre-inked stamper was cleaner and more convenient to use and gave crisp and clean impressions every time it was used.

There was still the problem of unwanted impressions. Also, the pre-inked elements do not have the advantage of a wet ink pad to clear away debris and abrasive particles from the face of the element, which interferes with the imprint and can damage the raised characters. Covers were provided by some manufacturers to protect the element when not being used.

A convenient, unitary structure was recently developed in which a two-part cover was hinged to the element holder and formed a handle in the open position and rotated together to form a closed container. Unless the stamp device was closed, it could still result in unwanted imprints or ink transfer.

STATEMENT OF THE INVENTION

An improved ink stamp is provided in accordance with the invention. The stamp element is surrounded by a shield which slides and retracts. A simple, one-piece cover rotates from a position in front of the element to a position 180° away on the top of the device. The shield prevents undesired ink transfer and allows one to carefully position the stamper before making an imprint. The rotatable cover protects users from the element and protects the element from dirt, debris, abrasive particles, etc., when the stamp is not is use.

The stamp of the invention is constructed of few parts and can be mass produced at low cost from mainly plastic materials. The stamp is reliable and more convenient to use. The stamp will be more efficient in an office atmosphere since it will not require as much clean-up time by employees for stains, or repackaging, or redoing of documents that have been imprinted incorrectly or smudged.

These any many other features and attendant advantages of the invention will become apparent as the invention becomes better understood by reference to the following detailed description when considered in conjunction with the accompanying drawings.

DESCRIPTION OF THE PREFERRED EMBODIMENTS

Figure 1:
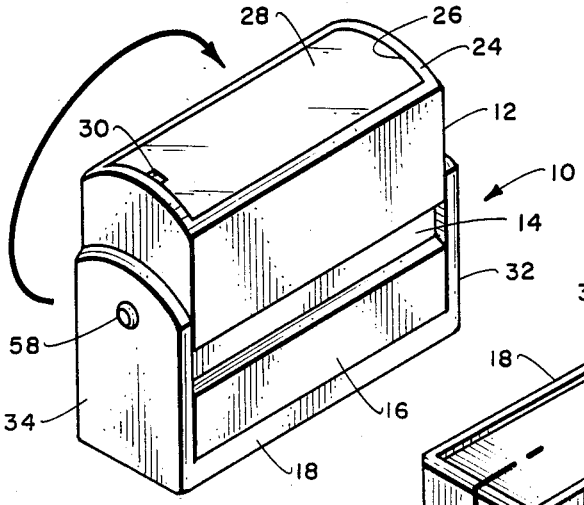
FIG. 1 is a perspective view of the stamp of the invention with the cover shown in the closed position.
Figure 2:
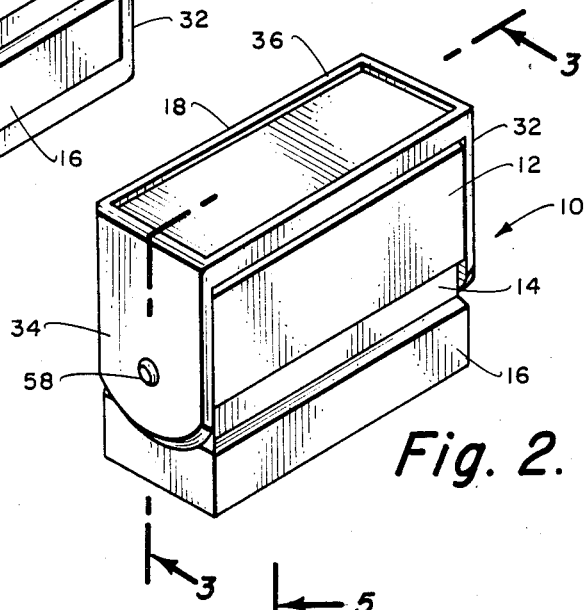
FIG. 2 is a perspective view of the stamp with the cover shown in open position.
Figure 3:
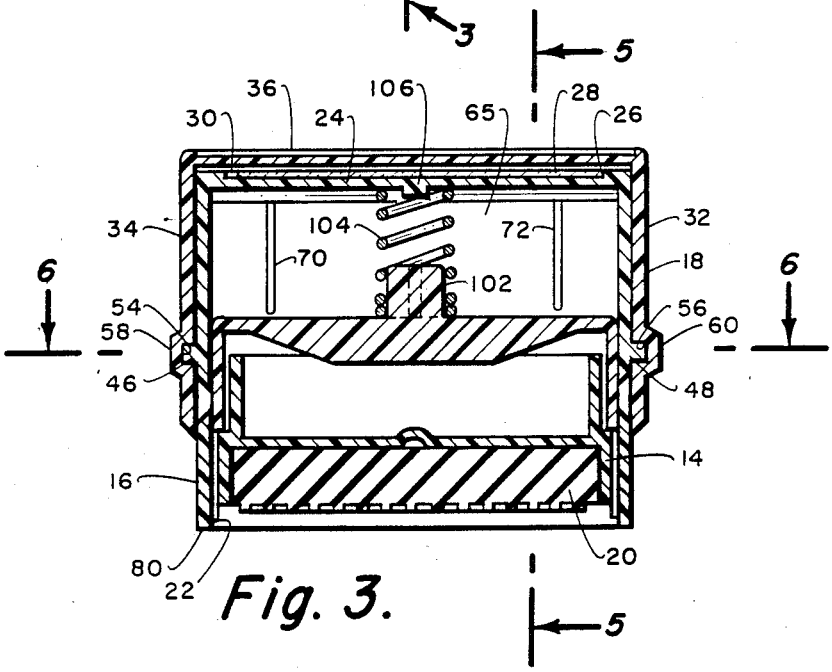
FIG. 3 is a view in section taken along line 3—3 of FIG. 2.

Referring now to FIGS. 1 to 3, the stamp 10 of the invention is formed of a top housing 12 and a two-part bottom portion including a stationary stamper holder 14 and a translatable shield 16. A pre-inked or inkable stamp element 20 is received in a cavity 22 in the lower face of the holder 14. A rotatable cover 18 rotates from a position in front of the stamp element 20 to a position over the curved top wall 24 of the housing 12. The top surface 24 may include a recess 26 for receiving a pre-inked sample of the message address, etc., on the stamp element 20. The sample can be held in place with a transparent cover 28 which is held in place by friction and is removed by inserting a fingernail or pointed instrument into the slot 30.

Figure 4:
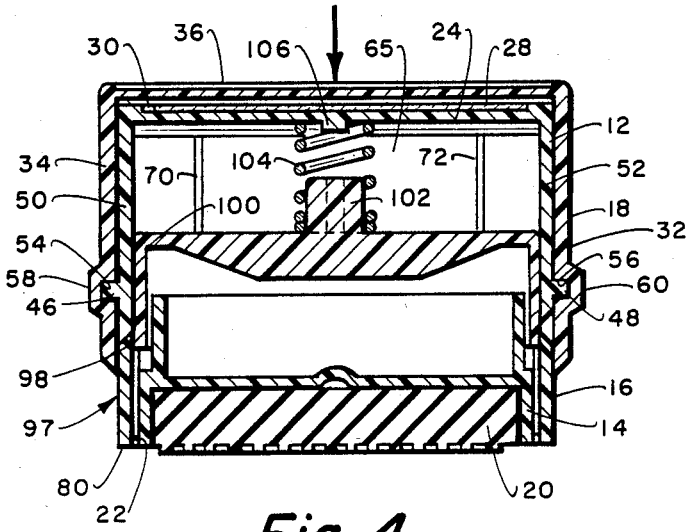
FIG. 4 is a cross-sectional view of the stamp of the invention with the stamp element shown in print position.
Figure 5:
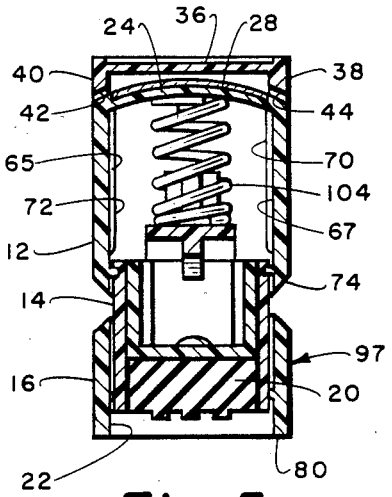
FIG. 5 is a view in section taken along line 5—5 of FIG. 3.

Referring now to FIGS. 3, 4 and 5, the rotatable cover 18 is a U-shaped member having two side arms 32, 34 joined by the cover face 36. Border strips 38, 40 are provided on each side of the cover face 36. The strips 38, 40 terminate in upwardly slanted edges 42, 44 which are almost parallel when in open position to the curved surface of the top wall 24 of the housing as shown in FIG. 5. The pivoting means for the cover can take many forms but is conveniently formed by means of a set of studs 46, 48 provided on the side walls 50, 52 of the housing 12. The studs 46, 48 are received in recesses 54, 56 in the inner surface of the side arms 32, 34. The recesses may be formed by forming an aperture, the outside of which is covered with a disc 58, 60.

Figure 6:
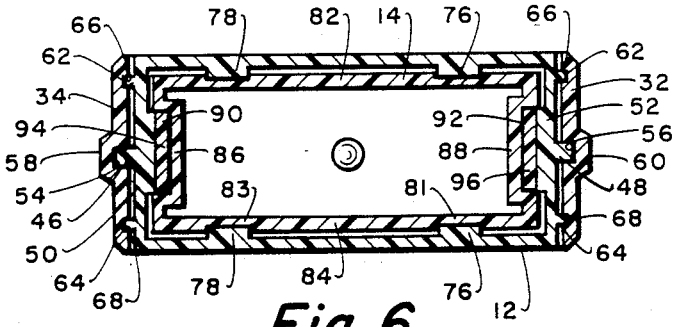
FIG. 6 is a further view in section taken along line 6—6 of FIG. 3.

Referring now to FIG. 6, the cover 18 may be provided with a locking assembly such as a pair of smaller studs 62, 64 provided on the side walls 50, 52 of the housing 12, which may be disposed on each side of the pivot studs 46, 48. The locking studs 62, 64 are received in corresponding detents 66, 68 joined on the inner surface of each side arm 32, 34 when the cover is in either the fully open position or in the fully closed position. The pivot studs 46, 48 are preferably located in the midpoints of the sides of stamper 10 and the length of the radius of rotation is selected so that the cover 18 is in contact position with the top surface 24 of the housing 12 when in the open position and with the lower edge 80 of the translatable shield 16.

Referring now to FIGS. 3 and 5, the inside surfaces of the front and back walls 65, 67 of the housing 12 are provided with a set of strips 70, 72 which start a short distance from the lower edge 74 of the housing 12. The strips 70, 72 act as a stop for the stamper holder 14.

Referring now to FIG. 6, the two side walls 86, 88 of the holder 14 each have outward facing grooves 90, 92 forming a track for the correspondingly shaped posts 94, 96 of the translatable shield 16. The shield contains a rectangular hollow base member 97 whose inner dimensions are just larger than the outer dimensions of the holder 14 so that the shield can slide back and forth over the holder. The posts 94, 96 are attached to upper edge 98 of the base member 97 and are positioned just with the inner wall of the base. The two posts 94, 96 are joined by a top plate 100 on which is mounted an upwardly standing post 102 for mounting the spring 104. A knob 106 may be provided on the inner surface of the curved top wall 24 of the housing to stabilize the position of the spring.

The stamper 10 is assembled by placing the spring 104 on the post 102 and bringing the housing into position to dispose the knob 106 within the upper end of the spring 104. The holder 14 is slid inside the shield 16 and the grooves 82, 83 snapped onto the tabs 76, 78. A pre-inked stamper element 20 with the desired data in raised characters is placed in the cavity 22. The cover 14 is placed onto the stamper 10 by placing the studs 46, 48 in the recesses 54, 56. The cover 18 is rotated and locked into open position and the stamper pressed onto a piece of sample paper. The shield 97 will retract, riding upwardly on the posts 94, 96. The element 20 is exposed and imprints the sample paper. The clear cover 28 is removed, the sample paper inserted and the cover replaced. The stamper is now ready for delivery to a customer.

The stamper can be formed of many different materials such as metal or resin. However, all parts except for the spring can be formed of plastic. The stamper contains few parts, is lightweight, yet sturdy and reliable. It is convenient to use and gives longer useful life to the stamping element since extraneous imprints are avoided due to the retractable shield and/or the rotatable cover. The element will also last longer since it is protected by the cover when not in use and will not dry out as quickly and will not be chipped or cracked as readily.

It is to be realized that only preferred embodiments of the invention have been described and that numerous substitutions, modifications, and alterations are permissible without departing from the spirit and scope of the invention as defined in the following claims.

We claim:

1. A stamping device comprising in combination:

(a) a bottom member having spaced rectangular first ends and spaced rectangular first sides defining a rectangular space therebetween adapted to hold a self-inking stamp, said first ends each containing an inward vertical groove;

(b) a shield member having spaced rectangular second ends and spaced rectangular second sides, said shield member being sized to be a slide fit down over said bottom member and having a U-shaped member having ends connected to said second ends, said ends of said U-shaped member being positioned and adapted to slidably fit within respective ones of said grooves;

(c) a top member having spaced generally rectangular third ends, spaced rectangular third sides and a generally rectangular top piece interconnecting the top edges of said third ends and said third sides to form an enclosure, said shield member being sized to be a slide fit down over said bottom member and said ends of said U-shaped member, said top and bottom members having interlocking means adjacent their bottom and top edges, respectively, for releasably interconnecting said top and bottom members together with said U-shaped member disposed therebetween whereby said shield member can slide between extended and retracted positions;

(d) spring bias means disposed within said enclosure between said U-shaped member and said top piece for urging said shield member towards said extended position; and, (e) a U-shaped cover member having a pair of spaced fourth ends interconnected by a rectangular cover piece, said fourth ends being pivotally mounted adjacent the bottom edge of respective ones of said third ends such that said cover member is pivotable between a first position with said cover piece covering the space between the bottom edge of said second ends and said second sides whereby said shield member and said cover piece form a protective enclosure around said bottom member and a stamp contained therein and a second position wherein said cover piece is in close adjacent spaced relationship to said top piece whereby said top member and said cover member can be gripped in combination and pushed downward thereby urging said bottom member and a stamp contained therein to slide through said shield member against the bias force of said bias means to place said stamp in contact with a surface for stamping.

2. The stamping device of claim 1 wherein:

said third ends and said fourth ends include interactive detent means for releasably holding said cover member in said first and second positions.

3. The stamping device of claim 1 wherein:

(a) said bottom member contains a bulkhead between the top and bottom edges of said first ends and said first sides defining a space for containing a stamp therein; and, (b) said grooves extend only from the top edge of said first ends to said bulkhead.

4. The stamping device of claim 1 wherein:

said cover member includes sealing strips extending at right angles thereto along the edges of said cover piece between said fourth ends whereby when said cover member is in said first position said sealing strips reduce the space between said cover piece and said second sides for the entry of contaminants to a minimum.

5. The stamping device of claim 4 wherein:

said sealing strips are angled from their outer edges to their inner edges towards said cover piece whereby maximum sealing is provided while still providing clearance for said cover member to pivot past said shield member.

6. A stamping device comprising in combination:

(a) a bottom member having spaced first ends and spaced first sides defining a rectangular space therebetween adapted to hold a self-inking stamp;

(b) a shield member having spaced second ends and spaced second sides, said shield member being sized to be a slide fit down over said bottom member;

(c) a top member having spaced third ends, spaced sides and a top piece interconnecting the top edges of said third ends and said third sides to form an enclosure, said shield member being sized to be a slide fit down over said bottom member, said top and bottom members having interlocking means adjacent their bottom and top edges, respectively, for releasably interconnecting said top and bottom members together;

(d) a U-shaped member having ends connected to said second ends, said ends of said U-shaped member being positioned and adapted to slidably fit between said first and second ends with said U-shaped member disposed between said top and bottom members whereby said shield member can slide between extended and retracted positions; and, (e) spring bias means disposed within said enclosure between said U-shaped member and said top piece for urging said shield member towards said extended position; and, (f) a U-shaped cover member having a pair of spaced fourth ends interconnected by a rectangular cover piece, said fourth ends being pivotally mounted adjacent the bottom edge of respective ones of said third ends such that said cover member is pivotable between a first position with said cover piece covering the space between the bottom edge of said second ends and said second sides whereby said shield member and said cover piece form a protective enclosure around said bottom member and a stamp contained therein and a second position wherein said cover piece is in close adjacent spaced relationship to said top piece whereby said top member and said cover member can be gripped in combination and pushed downward thereby urging said bottom member and a stamp contained therein to slide through said shield member against the bias force of said bias means to place said stamp in contact with a surface for stamping.

7. The stamping device of claim 6 wherein:

said third ends and said fourth ends include interactive detent means for releasably holding said cover member in said first and second positions.

8. The stamping device of claim 6 wherein:

said first ends have inward vertical grooves therein in which said ends of said U-shaped member are slidably disposed.

9. The stamping device of claim 8 wherein:

(a) said bottom member contains a bulkhead between the top and bottom edges of said first ends and said first sides defining a space for containing a stamp therein; and, (b) said grooves extend only from the top edge of said first ends to said bulkhead.

10. The stamping device of claim 6 wherein:

said cover member includes sealing strips extending at right angles thereto along the edges of said cover piece between said fourth ends whereby when said cover member is in said first position said sealing strips reduce the space between said cover piece and said second sides for the entry of contaminants to a minimum.

11. The stamping device of claim 10 wherein:

said sealing strips are angled from their outer edges to their inner edges towards said cover piece whereby maximum sealing is provided while still providing clearance for said cover member to pivot past said shield member.

* * * * *